US010741031B2

(12) United States Patent
Williams et al.

(10) Patent No.: US 10,741,031 B2
(45) Date of Patent: Aug. 11, 2020

(54) THREAT DETECTION PLATFORM WITH A PLURALITY OF SENSOR NODES

(71) Applicant: TekConnX, LLC, Fredericksburg, VA (US)

(72) Inventors: Kevin Williams, Fredericksburg, VA (US); Earl Bentley, Fredericksburg, VA (US)

(73) Assignee: TEKCONNX, LLC, Fredericksburg, VA (US)

( * ) Notice: Subject to any disclaimer, the term of this patent is extended or adjusted under 35 U.S.C. 154(b) by 0 days.

(21) Appl. No.: 15/975,425

(22) Filed: May 9, 2018

(65) Prior Publication Data

US 2019/0019380 A1 Jan. 17, 2019

Related U.S. Application Data

(60) Provisional application No. 62/503,532, filed on May 9, 2017.

(51) Int. Cl.

| | |
|---|---|
| ***G08B 13/00*** | (2006.01) |
| ***G08B 21/02*** | (2006.01) |
| ***G08B 13/02*** | (2006.01) |
| ***G08B 13/196*** | (2006.01) |
| ***G08B 13/16*** | (2006.01) |
| ***G08B 19/00*** | (2006.01) |
| ***G08B 29/14*** | (2006.01) |

(52) U.S. Cl.

CPC ..... *G08B 13/02* (2013.01); *G08B 13/1672* (2013.01); *G08B 13/19632* (2013.01); *G08B 13/19645* (2013.01); *G08B 13/19656* (2013.01); *G08B 13/19682* (2013.01); *G08B 13/19693* (2013.01); *G08B 19/00* (2013.01); *G08B 21/02* (2013.01); *G08B 29/14* (2013.01)

(58) Field of Classification Search

None

See application file for complete search history.

(56) References Cited

U.S. PATENT DOCUMENTS

| | | | | |
|---|---|---|---|---|
| 7,690,004 | B1 * | 3/2010 | Dean | G06F 3/005 709/223 |
| 2004/0179018 | A1 * | 9/2004 | Sabella | G09G 5/393 345/536 |
| 2005/0012556 | A1 | 1/2005 | Bhushan et al. | |

(Continued)

OTHER PUBLICATIONS

Wu, Jie, et al., "Coverage Issue in Sensor Networks with Adjustable Ranges", In Proc. of the 2004 International Conference on Parallel Processing Workshops, Aug. 2004, ISBN: 0-7695-2198-3, pp. 61-68 (8 pages).

*Primary Examiner* — John F Mortell

(74) *Attorney, Agent, or Firm* — Buchanan, Ingersoll & Rooney PC

(57) ABSTRACT

The threat detection system described here includes a plurality of nodes that may each have a differently configured set of sensors for observing the area in the vicinity of each node. The nodes provide this information to a command center and/or Internet services so that operators can ascertain the threats in an area being monitored by the plurality of nodes. Threat analytics are performed on the information provided by the sensors in the nodes to further aid the operators' understanding of the threats in the area.

17 Claims, 8 Drawing Sheets

(56) References Cited

U.S. PATENT DOCUMENTS

| | | | | |
|---|---|---|---|---|
| 2010/0148940 | A1* | 6/2010 | Gelvin | G06F 15/173 340/286.02 |
| 2013/0257626 | A1* | 10/2013 | Masli | G08B 13/19613 340/691.6 |
| 2014/0253733 | A1 | 9/2014 | Norem et al. | |
| 2014/0292527 | A1 | 10/2014 | Sisneros | |
| 2015/0021990 | A1 | 1/2015 | Myer et al. | |

* cited by examiner

THREAT DETECTION PLATFORM WITH A PLURALITY OF SENSOR NODES

FIELD

The present disclosure describes a security solution, and more specifically, a security solution utilizing multiple modular and independent nodes for monitoring a defined area.

BACKGROUND

The increasing number of security threats directed against the general population has resulted in the public demanding a higher level of security at events and public gatherings. Attendees and participants at events and public gatherings may be threatened by malicious actors through a variety of vectors. For large gatherings at a sports venue, threats such as chemical and biological toxins may be of concern. For events in an urban area, such as a parade or outdoor festival, the threats may also include malicious actors with firearms or hijacked vehicles. To protect the public, organizers and government officials have sought to increase the security at such events and public gatherings. This desire for higher security is shared by the public, but must be balanced with the desire by those participating in the event or public gathering that their safety not require intrusive security measures that interfere with the event or gathering itself. Thus, there has been an increasing desire to create unobtrusive security solutions that can monitor the conditions in a particular area. There is also a desire for such a system to be easily reconfigurable so that a variety of threats may be monitored using the same general structure, or base unit. It is also desirable to create such a system using a plurality of nodes so that a larger area can be effectively monitored.

SUMMARY

This disclosure describes a threat detection system with a plurality of nodes that are each configured for monitoring an area in a venue, where at least one node includes a modular device for secure attachment to an object within the venue, the modular adapter having at least one compartment for interchangeably receiving a sensor of a specified type, a processor, and a transceiver for data communications over a network, and a controller configured to determine a safety threat level based on data received from at least the one sensor in the field. The at least one sensor is disposed in a housing configured to be detachably connected to the modular device. The housing includes a first connector that mates with a second connector on the modular device. The modular device includes a processor configured to detect the type of the sensor disposed in the housing to which the modular device is connected. The adapter includes a processor configured to detect the connection to a housing and identify the type of sensor provided in the housing. The processor is configured to perform a diagnostic test on the at least one sensor provided in the housing. Each node is configured to communicate with at least one of the sensor and the diagnostic data to the controller. The controller includes a processor configured to perform threat analytics on the received sensor data. The controller includes a display that aggregates received sensor data into visual format for a user. The display is configured to display a result of threat analytics processing on the received sensor data. The display is configured to identify the location of a threat or incident based on the result of the threat analytics processing. The plurality of sensors are arranged in zones, and the display is configured to display threat analytics processing associated with each zone. The display associated with each zone is provided in one of a plurality of windows. The plurality of windows are tiled in a sequence based on the result of the threat analytics processing. Each of the plurality of windows is displayed in dimensions based on the result of the threat analytics processing, where a window associated with sensor data indicating an imminent or current threat has a larger size than a window associated with sensor data indicating no threat. The controller is configured to trigger an audible or visual alarm based on the result of the threat analytics. At least one sensor is configured to detect at least one of a gunshot, smoke, fire, motion, temperature, light, sound, hazardous chemicals, explosive materials, nuclear radiation, and radio-frequency identification tags. At least one sensor is configured to capture images. The housing of the modular device is configured to be securely attached to an animate or inanimate object. If the modular device is securely attached to an animate object and the animate object is within a zone having a detected threat, the controller is configured to control other sensing devices in the zone for tracking at least one of a movement and position of the animate object.

This disclosure also describes a method for detecting a threat in a venue using a network of sensing nodes including receiving data from a plurality of sensing nodes in the network, where a plurality of sensing nodes are arranged in zones, performing threat analytics on the data from each sensing node, and displaying the results of the threat analytics for each zone in respective windows where the windows are ordered or sized relative to a level of threat determined from the threat analytics result, where the order or size of the respective windows change in real-time based on the updated threat analytics results. The size of the windows may be gradually changed or instantly changed, or changed based on a predetermined time scale or period. Video or still images are displayed within at least a portion of one window in the display. Performing threat analytics includes calibrating each sensing node based on a location in the venue, recording baseline data of each sensor, comparing the received sensor data to the baseline data associated with the respective sensor, determining whether companion results indicate a safety event in the location of a respective sensing node, and issuing a control or notification signal based on the result of the determination. The method also includes changing the size or order sequence of the windows in the display based on the control or notification signal, where the control or notification signal includes a score associated with a threat level and the size or sequence placement of a respective window is adjusted based on the score in relation to other windows in the display. The method also includes triggering a visual or audible alarm or notice based on the control or notification signal. The control or notification signal is configured to control a plurality of sensing nodes in a common zone to focus on a detected threat, and if at least one sensing node in the common zone includes a camera, the camera is controlled to provide images of an area in which the threat is detected. One of the plurality of sensing nodes is attached to an animate object, where the method further includes tracking movement of the animate object within a zone, where based on a received control or notification signal, a first processor of the sensing node attached to the animate object communicates with second processors of other sensing nodes in the zone, and determines a position of the inanimate object in the zone based on the proximity of the animate object to at least one other sensing node in the common zone.

This disclosure also describes a non-transitory computer readable medium encoded with a method for detecting a threat in a venue, where when the medium is placed in communicable contact with a processing device, the processing device is configured to execute the method including receiving data from a plurality of sensing nodes in the network, where a plurality of sensing nodes are arranged in zones, performing threat analytics on the data from each sensing node, and displaying results of the threat analytics for each zone in respective windows, where the windows are ordered or sized relative to a level of threat determined from the threat analytics results, the order and size of the respective windows changing in real-time based on updated threat analytic results.

DETAILED DESCRIPTION

Figure 1A:
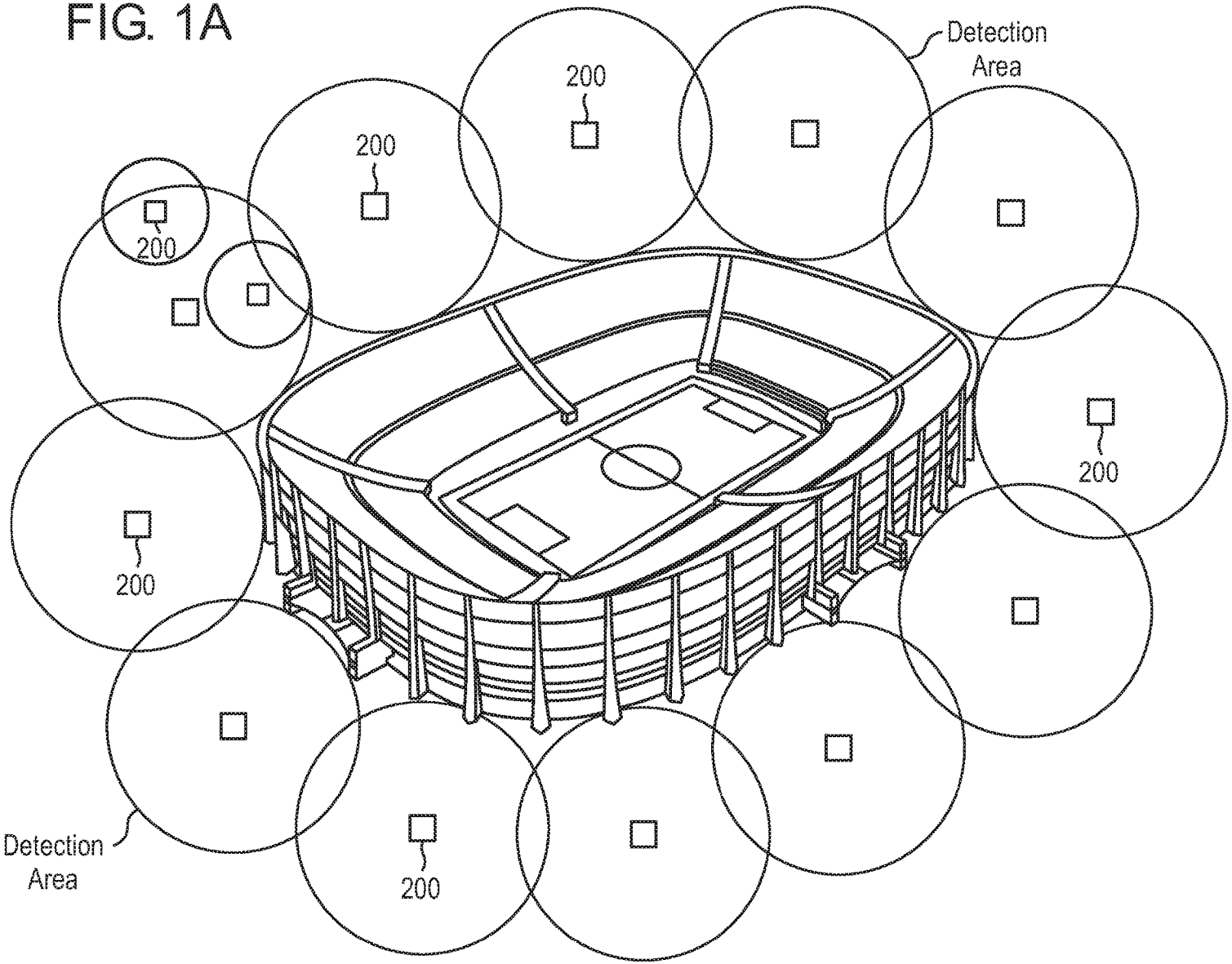
FIGS. 1A and 1B illustrate an overview of the threat detection system in accordance with an exemplary embodiment of the present disclosure.
Figure 1B:
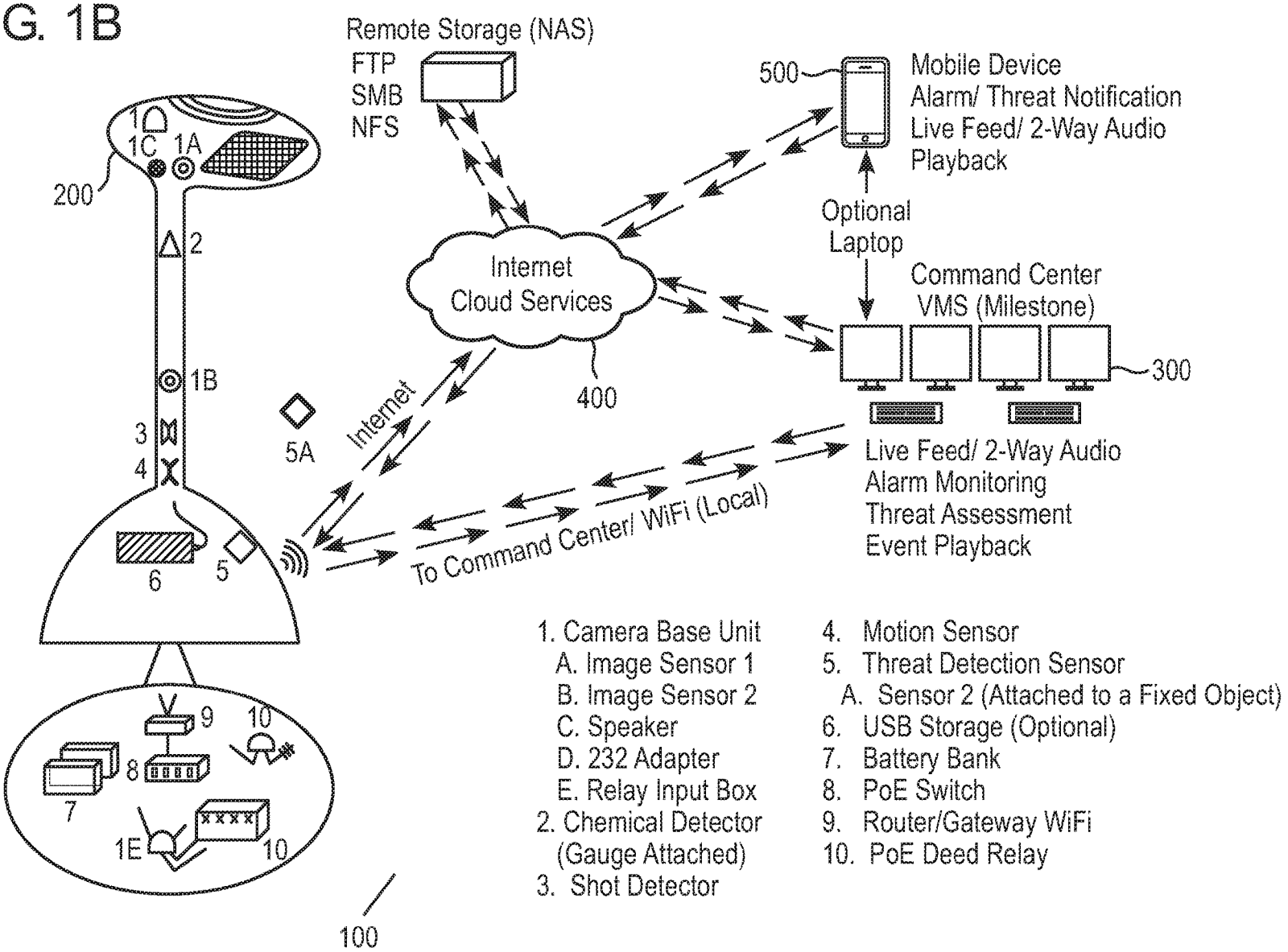

The threat detection system 100 disclosed herein includes a plurality of modular, independent, and reconfigurable nodes 200 that may be deployed in an area to help monitor the conditions in the area. The nodes may be deployed in a venue, such as an indoor or outdoor stadium. FIGS. 1A and 1B illustrate an overview of the threat detection system in accordance with an exemplary embodiment of the present disclosure. As shown in FIG. 1A, the number and placement of nodes at a venue is dependent on detection and communication ranges specific for each node and the total area for which detection is desired. For example, if the area for coverage is a 50×50 m2 area then the number of deployed nodes can range from 200 to 1000 depending on sensing range of 4 m to 12 m of each node. The coverage (e.g., detection) area for each node can be adjustable and determined based on a desired and/or specified energy consumption of the nodes. The appropriate coverage area for the network of nodes can be determined using known algorithms and techniques, such as those described in Wu et al., "Coverage Issue in Sensor Networks with Adjustable Ranges," Proceeding ICPPW '04 Proceedings of the 2004 International Conference on Parallel Processing Workshops, ISBN: 0-7695-2198-3, pp. 61-68 (August 2004). Each node 200 participating in the system 100 need not be identically configured. Instead, each node 200 can be configured to provide the desired type of monitoring for a particular location. Each node 200 that participates in the threat detection system 100 can independently operate and independently communicate with other components of the system 100 including a command center 300 that coordinates the operation of the entire system 300. The threat detection system 100 may also utilizes Internet services 400 to store information gathered by the nodes. These and other components of the threat detection system 100 are described below.

Nodes

Figure 2:
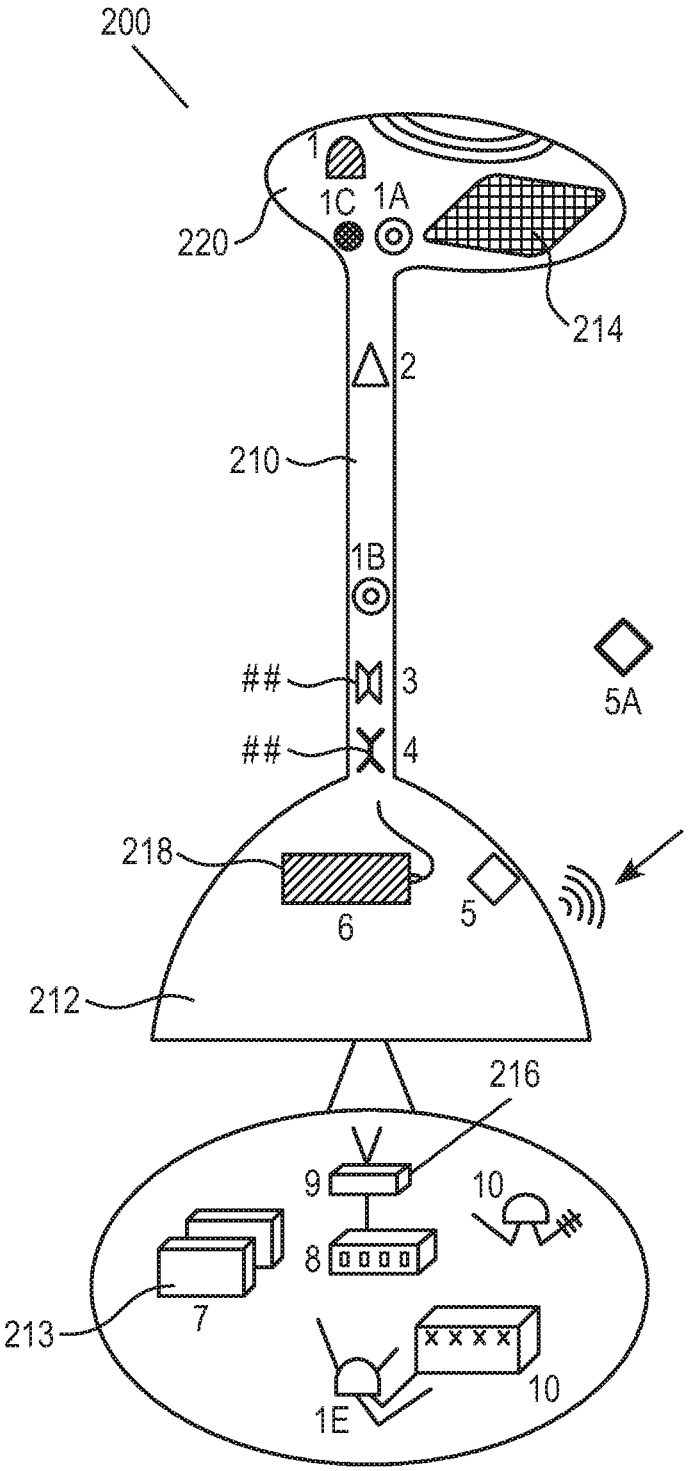
FIG. 2 illustrates a node of the threat detection system in accordance with an exemplary embodiment of the present disclosure in accordance with an exemplary embodiment of the present disclosure.

One embodiment of the nodes 200 included in the threat detection system 100 is shown in FIG. 2. Each node includes modules, or modular devices 204, 206, that can be securely attached to an object within the venue. Each node 200 then monitors that area, or zone, of the venue for threats.

Each node 200 includes a housing that protects the individual modules that are installed in each node 200. The housing includes a central stem portion 210 that connects a lower base 212 and an upper portion 214. The lower base 212 of the housing may include a modular device for securely attaching to an object in an area such as a venue. In other embodiments, the lower base 212 may rest on a relatively flat surface and not be secured to another object. In such embodiments, the weight of the lower base 212 may be higher than other portions of the node 200 so that the stability of the node 200 is not compromised.

Embodiments of the nodes 200 may include a centralized power supply 213 so that each module need not provide its own power, for example. The centralized power supply 213 may include a standard power connector that allows the node 200 and the modules to be powered by an outside power source. In some embodiments, centralized power supply 213 may also obtain its power from an outside power source over another standardized means such as Power over Ethernet (PoE) so that the number of connectors used by each node 200 is reduced.

Certain embodiments of centralized power supply 213 included in a node 200 may include batteries or other energy storage components to provide energy to the modules and the node 200 even if the node 200 is disconnected from an outside power source. In certain embodiments, the centralized power supply 213 may also include a solar panel 214 so that the node 200 need not be constantly connected to an outside power source. Inclusion of a solar panel 214 is particular suitable for nodes 200 that are deployed in outdoor areas. In some embodiments, both solar panels 214 and energy storage components may be included in a node 200 so that interruptions in the availability of outside power do not affect the operation of the node 200.

Certain components of the node 200, such as a solar panel 214, may be arranged in certain portions of a node 200 to optimize performance. For example, the solar panel 214 may be arranged at an uppermost portion of the node 200 so that the maximum amount of sunlight is collected. Similarly, in some embodiments of the node 200 the centralized power supply 213 may be located in the base so that the stability of the node 200 is not compromised.

The node 200 may also include components, such as lighting, that are not directly related to sensing the surroundings to assess the threats. which may coordinate with installed modules. If, for example, a module detects activity in a certain direction, an embodiment of the node 200 may direct lighting in that direction so that additional sensors can assess the activity. The node 200 may also include speakers or other components that may be used to emit an alarm and warn individuals near the node 200. In addition, the lighting available in a node 200 may be used as a form of visual alarm that may be more easily perceived by those at a distance or by those who have difficulty in perceiving sound. In some embodiments, the node 200 may include features to offer services to nearby individuals such as standard power connectors so that the node 200 can be used as a power station.

Embodiments of the node 200 may include a common communications bus 208 so that each module 204, 206 operating in the node 200 may communicate with each other, and with other aspects of the threat detection system 100 including other nodes, the command center 300, or other remote services 400. Such embodiments would therefore centralize the communications in and out of the node 200 which helps reduce the overall complexity of the system 100 which includes a plurality of nodes 200. Such embodiments would also simplify the individual modules by allowing a shared component of the node 200 to perform common tasks. The common communications bus may be wired, wireless, or a combination of both, depending on the module, the node 200, and the operating environment. For example, a wired communications bus may be more reliable in areas where electromagnetic interference is a concern.

Embodiments of the node 200 may also include a communications system 216 for transmitting data to and receiving data from a command center 300 or Internet service 400. The communications system 216 may rely on wired networking technologies such as Ethernet or wireless networking technologies such as Wi-Fi, or mobile communications standards like LTE. In some embodiments, the wired network technology may allow for both communications and power to flow through the same cable. Such an embodiment of the node 200 may employ PoE technologies, for example. Such an embodiment is desirable because it reduces the number of wired connections that must be established between the node 200 and the other aspects of the threat detection system 100. When the communications system 216 is included in the node 200, certain modules will rely on this feature to transmit information to and receive instructions from the command center 300 or Internet service 400. By relying on this feature of the node 200, the individual modules will be simplified. Typically, a node 200 with such a communications system 216 will also include the common communications bus 208 described above to further simplify the individual modules and to also simplify the node 200. Embodiments of the communications system 216 contained in a node may include conventional components such as an Ethernet port, a PoE capable Ethernet port, a wireless networking adapter, or a cellular radio. In certain embodiments, the communications system 216 may include several of these components to facilitate the use of the node 200 in a variety of scenarios. For example, a node 200 may include a communications system 216 with a PoE capable Ethernet port, a wireless networking adapter, and a cellular radio, so that in a variety of scenarios the node 200 will still have connectivity allowing it to transmit information to and receive instructions from the command center 300 or Internet service 400. In certain embodiments, a communications system 216 may employ multiple communications techniques in a redundant manner, or may only receive instructions using one communications technique and transmit information using another communications technique. For example, a node 200 may receive instructions using the cellular radio, but transmit information using the Ethernet port.

Nodes 200 may also include a processor or controller that coordinates the operation of components of the node 200 and, in some embodiments, the operation of the modules of the node 200. For example, the processor or controller 202 of the node 200 may instruct and/or coordinate the operation of the centralized power supply 213 so that the energy storage components are used in the most efficient manner while the solar panels 214 are collecting energy. To facilitate the operation of modules, the node processor or controller may detect the type of sensors available in the various modules in the node 200 and coordinate the communication of information from one module to another. The node processor 202 or controller may, for example, receive instructions from one module inquiring as to the availability of a capability in another module. The node processor or controller 202 then determines whether such capability is currently available and establishes communications between the modules when such capability is available. The node processor or controller 202 may perform other tasks such as performing diagnostics or calibration routines to ensure the proper operation of the sensors included in the modules. Calibration routines may include, for example, establishing the baseline for the information collected by the sensors so that threat information may be more easily detected.

The node processor or controller 202 may also be configured to perform threat analytics on sensor data collected by the modules. In some embodiments, the node processor or controller 202 may be configured to perform initial threat analytics before transmitting the resulting information to the command center 300. The initial threat analytics may, for example, remove extraneous or irrelevant data prior to transmission to the command center 300 so that bandwidth utilization is minimized. In other embodiments, the initial threat analytics may perform data processing so that the resulting information contains an aggregate of the sensor information obtained by the node 200. For example, in a scenario where a sound reminiscent of a gunshot or an explosion is detected by an audio module, the initial threat analytics may aggregate the information from the audio module with information obtained from a visual module and information obtained from a chemical detection module to facilitate threat analysis by the command center 300. In another embodiment, the node processor or controller may perform a specific operation after the detection of a threat. Such an embodiment would result in the modules of the node 200 performing a tracking operation so that the origin of the threat is observed. The tracking operation may require the combined operation of various modules to properly assess the threat. In such a tracking operation, different types of information regarding the threat such as audiovisual information is aggregated with chemical and radiation information so that the operator can quickly make a determination as to how to react to the tracked threat.

In some embodiments, the node processor or controller creates a visual presentation of the sensor data that aggregates the sensor data. This may be useful in situations where communication between the node 200 and a command center 300 and/or Internet service 400 is sporadic but when the operator still needs to have an understanding of the threats in the vicinity, or zone, of the node. Such a display by the node processor or controller may also be useful when the nodes are being deployed in the venue. In certain embodiments, the node processor or controller will also trigger an audible or visual alarm based on the result of threat analytics. This is again addressing the situations where communication between the node 200 and the command center 300 and Internet services 400 may be sporadic.

Nodes 200 may further include a data storage component 218. The data storage component 218 is used to store instructions and data for use by the node 200 or by the modules associated with the node 200. For example, when the node 200 includes a processor or controller, certain instructions may be stored in the data storage component 218. In other embodiments, when the node processor or controller is, for example, performing threat analytics on the sensor data collected by the modules, the data being processed or the processed data may be stored in the data storage component 218. In certain embodiments, the data storage component 218 may be used to redundantly store information that was transmitted or is to be transmitted to a command center 300 or an Internet service 400. Such a situation would therefore allow for the node 200 to become disconnected from the command center 300 or Internet service 400 but still collect and store the information gathered by the modules. In such an embodiment, when the connection to the command center 300 or Internet service 400 is restored, any accumulated data is transmitted from the node 200. In certain embodiments, the data storage component 218 includes ports that allow for the connection of storage media so that the information contained in the data storage component 218 can be retrieved for further storage or processing.

Individual modules may be installed in any appropriate portion of the node 200 and are arranged in a manner most suitable for the particular individual module and most suitable for installation in the node 200. For example, modules that are of considerable density may be placed in lower portions of the node 200 to maximize stability and reduce the amount of weight that is to be supported by the central step portion 210. The manner by which the modules are installed into the housing of the node 200 varies may vary based on the module. A motion sensor module may, for example, be mounted in a manner that allows for unobstructed observation of the area surrounding a node 200. A radiation detecting module may, in contrast, be mounted in a manner where any available space is utilized because the radiation detected by the module is not affected or obstructed by the node 200. Other techniques of attaching the modules to the node 200 are known to those of skill in the art and are not specifically enumerated here.

The specific arrangement of certain modules in the housing 210 may vary in each node 200, even amongst nodes 200 participating in a threat detection system 100. Instead of requiring a specific arrangement, the modules each include common features and connectors so that they may be incorporated into a particular node 200 as needed. For example, the modules may share common power and communications interfaces so that each module can be incorporated into the node 200 at any available suitable location. In addition to improving manufacturability and reusability of both the modules and the nodes 200, such shared aspects also help reduce the cost and complexity of individual modules.

In some embodiments, a module may operate at least partially outside of the housing of the node 200. Such a remotely secured module would include a modular device for secure attachment to an object that is not the node 200. Such a module would continue to be considered a part of the overall threat detection system 100 by virtue of its usage of at least some of the features of the node 200. In one embodiment of such a module, the remotely secured module will use the wireless aspect of the communications bus of a node 200 so that the remotely secured module can interact with other modules of the node, the node itself, and other aspects of the threat detection system 100.

In some embodiments of module, at least one sensor or other component is securely externally attached to a mobile or stationary (e.g., animate or inanimate) object that is not the node 200 but communicates with other components of the same module. This is particularly suitable for modules that benefit from having multiple sensors that are spatially separated. In this embodiment of the module, the securely externally attached component includes a transceiver for communicating with other aspects of the module installed in the node 200. By incorporating securely externally attached components in this manner, other aspects of the threat detection system need not be aware that the at least one sensor or other component is not physically interfacing with the node 200.

Other embodiments of the remotely secured module may include the capability to participate with more than one node 200 when the capabilities of each of the nodes 200 differ, when the reliability of communications between each of the nodes 200 differs, or other pertinent factors.

Nodes need not take the form of what is depicted in FIG. 2. In some embodiments, nodes 200 and the modules included in the node 200 may be disguised as pieces of infrastructure or other structures so that the public is not aware they are being observed and/or monitored.

Modules Generally

Each module configured to be installed in each node 200 includes a housing, a processor, and a transceiver. The module housing includes a modular device for secure attachment to the node 200. The module housing is appropriately shaped to protect the components of the module while also exposing aspects of the module such as sensors to the environment. Such a module may also include the common connectors needed to interface with aspects of the node 200 including a centralized power supply 212 and/or a communications bus, for example.

The module processor performs at least some processing on the raw sensor data obtained by the sensors included in the module. In some embodiments, the module processor performs diagnostics or calibration routines to ensure the proper operation of the individual module. Such diagnostics or calibration routines may be requested by the node processor or controller, or may be separately executed by the module processor. Certain embodiments of the module include module processors that can detect the type of the sensor installed in the module, and can also detect when the module is installed in the node.

The module processor may, in some embodiments, perform substantial portions of the processing of the sensor data to provide information that is easily used by other modules and/or by the command center 300. For example, in an embodiment where the module is configured to derive a vector or region from which it appears a threat originates, the module processor performs the necessary calculations to derive the vector before transmitting information onto the communications bus of the node 200. In other embodiments, the module processor performs these calculations but also transmits the information used to derive the vector so that further analysis is possible.

The modules may also share aspects other than physical features. For example, the modules may communicate using a common protocol so that information obtained from one module can be used in another module operating in the same node 200 or another node 200 of the threat detection system 100. In other embodiments, the modules may transmit and receive instructions from other modules in the node 200 or another node 200 of the threat detection system 100. A motion sensor module may, for example, trigger the operation of a camera module 220 in the same node 200 to obtain an image or video of the area where motion was detected, and may also trigger the operation of a camera module 220 in nearby nodes 200 in the system 100.

As discussed, certain modules may be remotely secured modules that operate at least partially outside of the housing of the node 200. These remotely secured modules may be secured to an animate object, for example, so that the animate object may be tracked as it travels through the venue and passes in the vicinity of the deployed nodes 200. When such an animate object is tracked by the remotely secured module, the plurality of nodes 200 may coordinate their observations of their respective zones in the venue so that the movement and position of the animate object is monitored. Additionally, in some embodiments, the tracked animate object may be observed by multiple nodes 200 that share responsibility for a particular zone. In such a situation, the different nodes 200 may employ their differing sensor capabilities to provide the maximum amount of information regarding the threat.

These remotely secured modules will, however, utilize certain aspects of the nodes 200 such as the communications bus so that the complexity of the overall threat detection system 100 is reduced. Like the modules that are installed in each node 200, remotely secured modules include a housing, a processor, and a transceiver. These modules may, however, include a housing that lacks features such as the common connectors needed to interface with the node 200 but instead includes a modular device for secure attachment to an object.

In addition to the housing, the processor, and the transceiver, each module includes components necessary to perform its function including at least one sensor. In some embodiments of the modules, the sensors are interchangeable. In some embodiments, a module may not provide any sensory data but may perform another necessary function for the operation of the node 200. One embodiment of the module may include connectors such as USB ports that facilitate the movement of data to and from the node 200, but do not contribute to the sensory information considered by the threat detection system 200. Another embodiment of the module may include additional energy storage components to improve the ability of the node 200 to operate without an outside power source.

Certain modules may operate more optimally when arranged in different portions of the nodes 200 and may include a housing tailored for such placement. The camera module 220 shown in FIG. 2 and described in greater detail below may, in some embodiments, be formed so that the module 220 is easily secured to an upper portion of the node so that the observable area is maximized. Other modules may be formed in a manner that facilitates the operation of the sensor by, for example, directing the sound originating from any direction in a manner that improves recognition by an audio sensor. Still other modules may include sensors that detect threats that are not obstructed by either the module housing or the node housing. The variety of shapes and forms available to create a housing for a module, and the corresponding portion of the node housing for securing the module, are within the skill of an ordinarily skilled artisan and are not specifically enumerated here.

Typically, the modules will detect gunshots, smoke, fire, motion, hazardous chemicals, explosive materials, nuclear radiation, radio-frequency identification tags, and changes in the vicinity of the node 200 such as the temperature, light, and sound. Several common types of modules included in the embodiment of the node 200 shown in FIG. 2 will now be described. Other types of modules may include sensors for seismic disturbances, radio waves, inaudible sound frequencies, infrared signatures, and other types of environmental information that may be useful in identifying threats.

Camera Module

Figure 3:
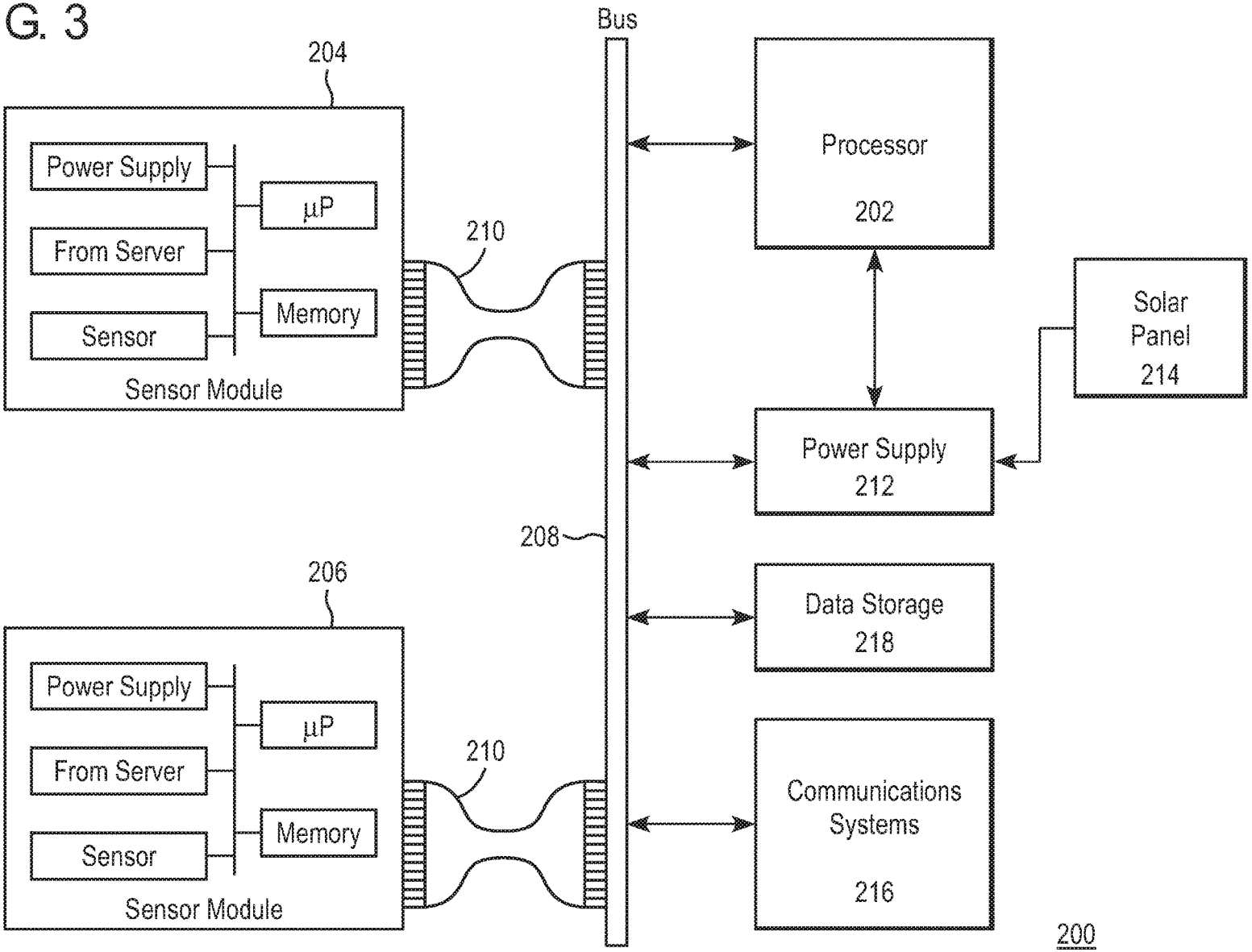
FIG. 3 illustrates a node with installed sensor modules in with an exemplary embodiment of the present disclosure.

The node 200 depicted in FIG. 2 includes a camera module 220 with at least one image sensor. The camera module 220 shown in FIG. 3A is designed to provide visual information of the observable area in the form of individual images, video streams, or both. In the embodiment shown in FIG. 2, the camera module 220 is placed on an upper portion of the node 200 so that the area observable by the camera module 220 is increased and the possibility of obstruction by an object is reduced. A variety of different components may be included in the camera module 220 including standard or wide-angle lenses and flashes, for example. The camera module 220 may include multiple image sensors and lenses to maximize coverage of the observable area. The camera module 220 may also include components that facilitate interaction with other modules installed in the node 200. In one embodiment, for example, the camera module 220 may communicate with a motion sensing module 226 so that when motion is detected in a certain area, the camera module 220 obtains visual information in the area so that the threat can be assessed.

In some embodiments, the camera module 220 may preprocess certain information. For example, the camera module 220 may automatically consider weather conditions so that environmental effects such as rain, snow, and wind do not create false alarms. In further embodiments, the camera module 220 will evaluate possible threats in the area and if the possible threat is sufficiently small, no alert will be issued. This is particularly suitable for scenarios where the threats being considered are those from humans and vehicles, and when the camera module 220 detects the activity of a small animal or other object, for example.

The camera module 220 may be entirely enclosed by the camera module housing. In some embodiments of the camera module 220, at least one component is separate from the other components of the camera module 220. Such a separate component may be, for example, a flash component or an image sensor. Such a configuration may be desirable when additional lighting beyond what is available from the lighting included in a node 200 is needed. Such a configuration may also be desirable when an additional perspective of the threat being imaged is desired. Similar to the remotely secured module, the additional separate components includes a transceiver for communicating with other aspects of the camera module 220 installed in the node 200.

Audio Module

The node 200 depicted in FIG. 2 includes an audio module 222 shown in FIG. 3B. The audio module 222 is configured to receive sound from the external environment. The audio module 222 may, in some embodiments, include apertures that are configured to direct the sound from the external environment to a microphone or other audio sensor for processing. This type of audio module 222 is useful in situations where a determination of the origin of the sound is not necessary. In other embodiments of the audio module 222, the microphones or other audio sensors are exposed in a manner where it is possible to determine the origin of the sound while also protecting the microphone or audio sensors from the environment. Some embodiments of the audio module 222 may also include a speaker that provides alerts or other information to the individuals in the vicinity of the node 200.

Similar to the camera module 220, the audio module 222 may also include at least one component separate from the other components of the audio module 222. For example, such a component could be an additional microphone or audio sensor that is spaced from the other aspects of the audio module 222 so that the ability of the audio module 222 to detect audio in the environment is improved. In another embodiment, a separate component could be an additional speaker that is spaced from the other aspects of the audio module 222 so that a larger number of individuals can perceive the alerts or other information being broadcast from the speaker.

Chemical Detector Module

The node 200 depicted in FIG. 2 also includes a chemical detector module 224 shown in FIG. 3C. The chemical detector module 224 is configured to detect chemical threats in the vicinity of the node 200 using conventional techniques. Accordingly, the chemical detector module 224 includes apertures or other openings so that the external environment can be sampled and chemical threats are detected. Some embodiments of the chemical detector module 224 also include separate components that can be secured at other nearby locations so that the ability of the chemical detector module 224 to detect chemical threats is improved. In some embodiments, the chemical detector module 224 itself may be detached from the node 200 but nevertheless continue to communicate with aspects of the node 200 while in the vicinity of the node 200.

Motion Sensor Module

The node 200 depicted in FIG. 2 includes a motion sensor module 226 shown in FIG. 3D. The motion sensor module 226 is configured to detect moving objects and in particular people. The motion sensor module 226 includes sensors that record changes in the environment that result from motion. The sensors may record changes in the optical, microwave, or acoustic field in the proximity of the motion sensor module 226. In some embodiments, the motion sensor module 226 may include an emitter providing emissions for a passive sensor to perceive motion the area near the node 200 with the motion sensor module 226. The motion sensor module 226 may be of any type including passive infrared, microwave, ultrasonic, tomographic, or lighting based. In some embodiments, the motion sensor module 226 may also separate certain components to facilitate detection of motion in the vicinity of the node 200. For example, the separate component may include an emitter whose emissions are controlled and detected by the motion sensor module 226.

Shot Detection Module

The node 200 depicted in FIG. 2 includes a shot detection module 228 shown in FIG. 3D. The shot detection module 228 detects the location of gunfire using acoustic, optical, or other types of sensors, or a combination of sensors. In some embodiments, the shot detection module 228 includes an array of microphones or sensors to detect the sound of gunfire. In other embodiments, the shot detection module 228 includes an optical component for detection of the muzzle flash caused by the firing of a weapon. In certain embodiments, a combination of sensors are included in the shot detection module 228, such as optical and acoustic sensors, so that the detection of gunfire may be improved.

The above descriptions of specific modules that may be included in a node 200 should not be considered to be an exhaustive, or limiting, list of possible modules. Moreover, in some embodiments, the functionality of a module may be derived from several other modules. For example, the functionality of the separate shot detection module 228 may be derived from other modules installed in the node 200. For example, in a node with a camera module 220 and an audio module 222, the camera module 220 may be used to detect the muzzle flash caused by the firing of a weapon, and the audio module 222 may be configured to detect the sound of gunfire. In embodiments of the node 200 where a processor that aggregates information is included, such functionality may be controlled by the processors available in the camera module 220, the audio module 222, and the node 200. In other embodiments, the aggregation of data may be performed by the command center 300 or by other Internet services 400.

Magnetic Field Sensor Module

Through the use of magnetic field sensors, disturbances in the local electromagnetic field caused by the presence of ferromagnetic metal materials may be detected. Typically, magnetic field sensors are very sensitive and can detect items as small as a Universal Serial Bus (USB) flash drive, for example. Such sensors, although very sensitive, may generate a multitude of false positive signals and so measures may be taken to compensate for these possible false signals including the redundant deployment of magnetic field sensor modules and the usage of filtering techniques that remove the environmental or background magnetic field from the measured signal.

Command Center

Figure 4:
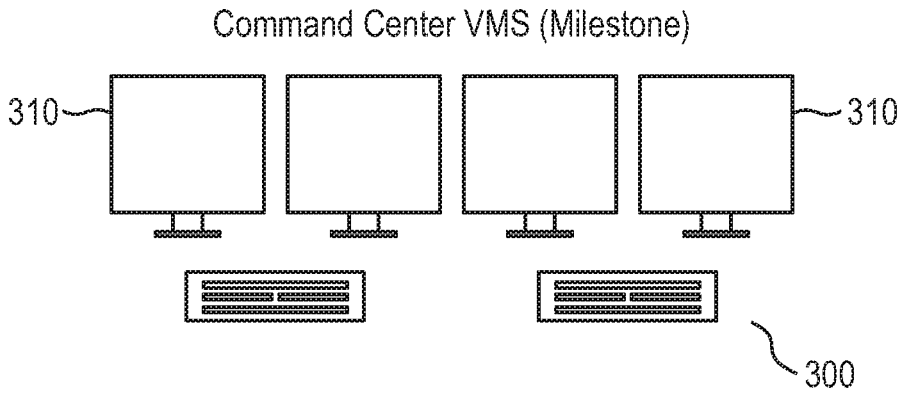
FIG. 4 illustrates one or more processors of the command center in accordance with an exemplary embodiment of the present disclosure.

The command center 300 shown in FIG. 4 receives information from the nodes 200 deployed in a particular area, and also issues instructions to the nodes 200. The command center 300 also transmits information to and receives information from Internet services 400. The information transmitted and received by the command center 300 may include video feeds, live sensor information from the modules installed in the plurality of nodes 200, and other types of information not gathered by the nodes 200 or modules but are nevertheless useful for providing context to the operators. For example, the information may include weather information from a third party that provides context to the sensor information being reported by the modules of the nodes 200.

The command center 300 includes processors and data storage components to process and store the information obtained from the sensors in the modules. In at least some embodiments, the command center 300 will aggregate the information collected from the sensors the plurality of nodes 200 so that the current threat level in an area may be determined. The information stored in the data storage components may be retrieved to provide event playback for past threats. In other embodiments, the command center 300 will utilize the processors to process the sensor information so that facial recognition algorithms may be used to identify individuals in the monitored area. In some embodiments, face tracking may be possible where the location of an individual is derived from recognizing the locations at which the individual's face is detected by other sensors. The face tracking may be performed on all successive frames of video until the individual is no longer within the field of view for a camera. In at least some embodiments, the face tracking algorithms can accommodate occlusions of the faces being tracked and can resule tracking after the face returns to the field of view. Attributes of the individual such as gender, age, and facial features (e.g., facial hair, smiles, open or closed mouths, open or closed eyes, glasses, or any other suitable "attribute" as desired) may be considered by the processors of the command center 300 as well. In other embodiments, the processors of the command center 300 are used to process the sensor information so that tracking and classifying objects at a location is possible. The algorithms employed by the control center 300 for these and other features need not operate on live sensor information but can also operate against previously acquired and stored sensor information. For example, the same algorithms may be used to identify individuals using live sensor information and using previously stored sensor information. Preferably, the algorithms described here are 300 can operate in real time so that live sensor information may be quickly processed and used to neutralize any threats. In certain embodiments, however, the algorithms may operate in close to real time or may operate in a manner where only previously stored sensor information is suitable.

The processors of the command center 300 perform the threat analytics needed to transform the information transmitted by the nodes 200 into information that can be easily processed and understood by the operators. For example, the processors may utilize the information from the nodes 200 to create a map of the area being monitored and the threats that exist in the monitored area. For example, the command center 300 may aggregate the information collected by the camera module 220 and the information collected by the audio module 222 so that the functionality of a shot detection module ##2 is provided.

In at least some embodiments, the command center transmits information to and receives information from a portable computing device 500 such as a smartphone, a laptop computer, or a tablet device. Some embodiments of the command center 300 include at least one display 310 for operators to receive information from the nodes 200 in a desired area. The displays may provide, for example, aggregated sensor data in a visual format, the result of threat analytics performed on the received sensor data in a visual format, the position of the nodes 200 observing zones of the monitored area and the position of any detected threats, and other formats useful for the operators to understand the current threat situation in the given area. Typically, the threat analytics will provide a visual display for the location of the threat or incident to the operator.

Figure 5A:
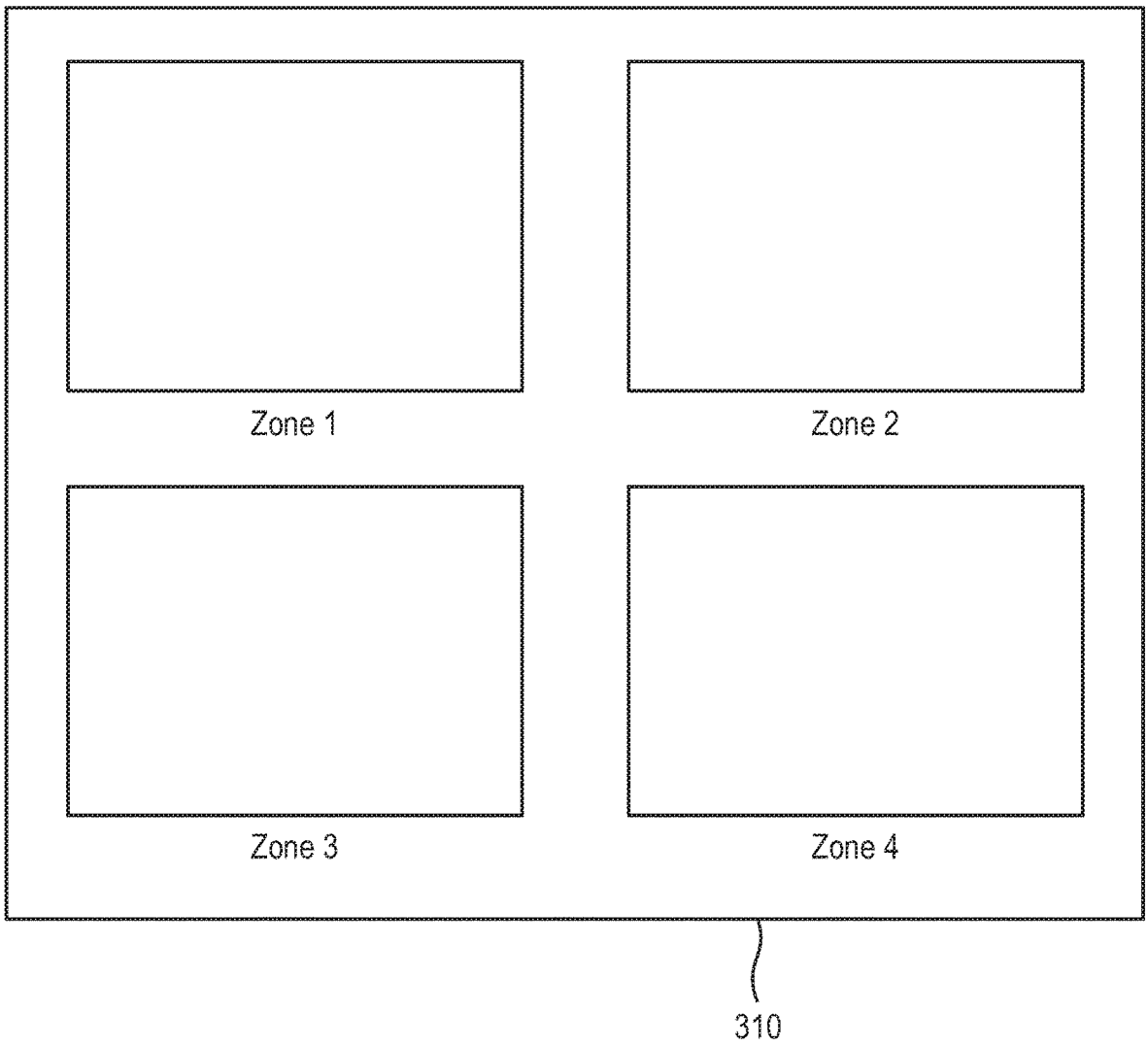
FIGS. 5A and 5B illustrate display configurations of the command center in accordance with an exemplary embodiment of the present disclosure.
Figure 5B:
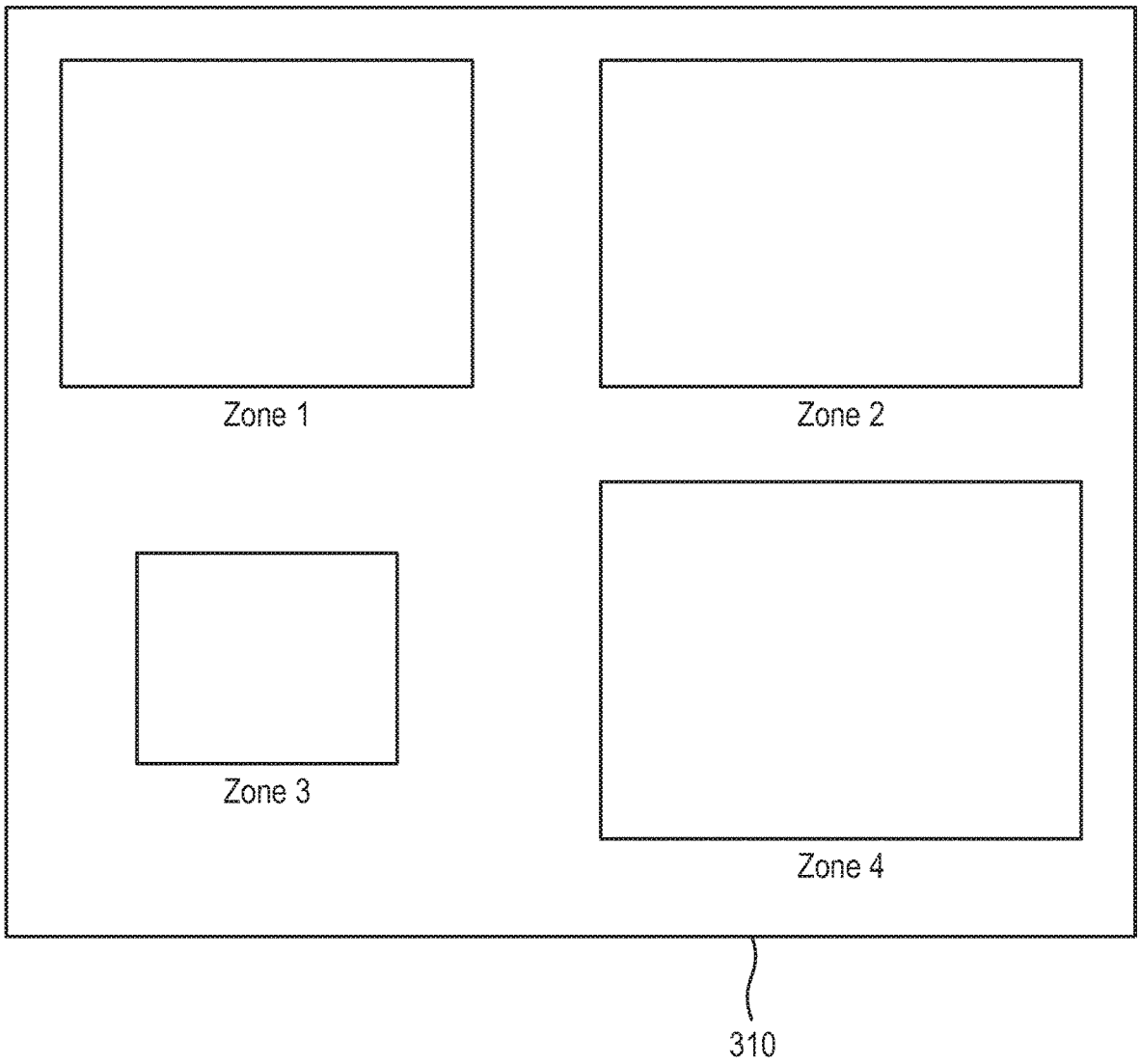

In at least some embodiments, the displays will present the information in a plurality of windows that are arranged in a manner suitable for the operator such as tiling a plurality of windows in a sequence based on the result of the threat analytics processing, arranging each zone in an individual window, or resizing each of the windows in a manner that emphasizes the information being displayed in the window. For example, when the threat is understood to be imminent or a current threat, the window displaying such threat information may be resized to be larger and/or more prominent (Zone 1, Zone 2, Zone 4 in FIG. 5B) than a window that is not displaying such threat information (Zone 3 in FIG. 5B). The resizing of the window may be performed gradually, instantly, based on a predetermined time scale or period, or any variation in between. FIGS. 5A and 5B show the resizing of display windows from a time T1 (FIG. 5A) to T2 (FIG. 5B) In addition to visual information provided by the displays 310 of the command center 300, audible and visual alarms may be provided to alert the operators of imminent or current threats. The audible and visual alarms may also be configured to be triggered when certain thresholds are exceeded. For example, an audible alarm may be configured to be triggered when multiple chemical detector modules 224 detect the same threat.

The visual information, along with the audible and visual alarms described above, may also be transmitted to portable computing devices 500. The portable computing devices 500 may also be used to perform certain aspects of threat analytics as well. For example, the portable computing device 500 may transform information that was already processed by the command center 300 so that the information is more easily consumed by the operator utilizing the portable computing device 500.

The command center 300 may also provide instructions that coordinate the functionality of the modules. For example, when a threat is detected, the command center 300 may transmit instructions causing a camera module 220 to focus on and track the movement of the threat in the vicinity of the node 200. In some embodiments, a processor of a sensing node may communicate with other processors in other nearby nodes so that multiple camera modules 220 may focus on and track the movement of the threat.

Internet Services

The Internet services 400 shown in FIG. 1 may receive information from and transmit instructions to the plurality of nodes 200. In at least some embodiments, the Internet services 400 may also receive information from and transmit instructions to the command center 300 and/or the portable computing device 500. The Internet services 400 may provide additional storage, additional processing capabilities, or a combination of both to the threat detection system 100. In some embodiments, for example, the Internet service 400 provides a redundant copy of the information stored at the command center 300. In other embodiments, the Internet service 400 provides a redundant copy of the information collected by the sensors of the modules of the nodes 200.

Threat Defection Platform

Using a combination of the capabilities described above, an integrated threat detection platform may be created that locates threats such as guns, knives, and shrapnel, or items such as physical storage media or other contraband. When the features of the above disclosure are combined, visual and audible alerts are provided to operators in the command center 300, for example, so that appropriate responses may be provided. In one embodiment, displayed alerts are overlaid onto a picture of an individual or onto a video of the individual in a manner that highlights the specific location of the possible threat. The displayed alert may take the form of a red box that is superimposed over the still image or over the video so that the operator can quickly ascertain the specific location of the threat. In some embodiments, the displayed alert is the synthesis of various sensory information obtained using the various nodes 200 that are communicating with the threat detection platform.

A variety of algorithms are employed so that the various sensory information being collected by the nodes 200 are presented to the operators in a simplified fashion. In some embodiments, the algorithms being employed may perform other tasks such as causing additional monitoring of a particular area when the sensory information being analyzed is insufficient to alert the operator, but is sufficient to warrant additional attention. Certain embodiments may employ algorithms that need not include weighing of different inputs and instead adjust the weighing of the information obtained from the sensors automatically. In still further embodiments, operators may influence the algorithm by, for example, adjusting the weight of a particular input.

In some embodiments, the alert being displayed includes other types of data that may be stored for further forensic analysis, or that may be transmitted to a different system for storage or further analysis. Information that may be stored for later forensic analysis or transmitted to a different system may include the contemporaneous still or video images of an area where the threat was detected, the time and the location of the threat, and other contemporaneous sensory information acquired by the threat detection platform. Such storage of contemporaneous information for later forensic use may be particularly useful for reconstructing the events surrounding a threat, or for identifying people associated with an individual considered to be a threat.

In addition to identifying specific contemporaneous threats, the threat detection platform may also monitor areas for undesired behaviors, such as a sudden change in the direction of a monitored object, a sudden increase in the speed of a monitored object, or a monitored object passing a predefined monitored location. In such an embodiment, the threat detection platform may employ certain algorithms to process the sensor information and monitor for such undesired behaviors.

Figure 6:
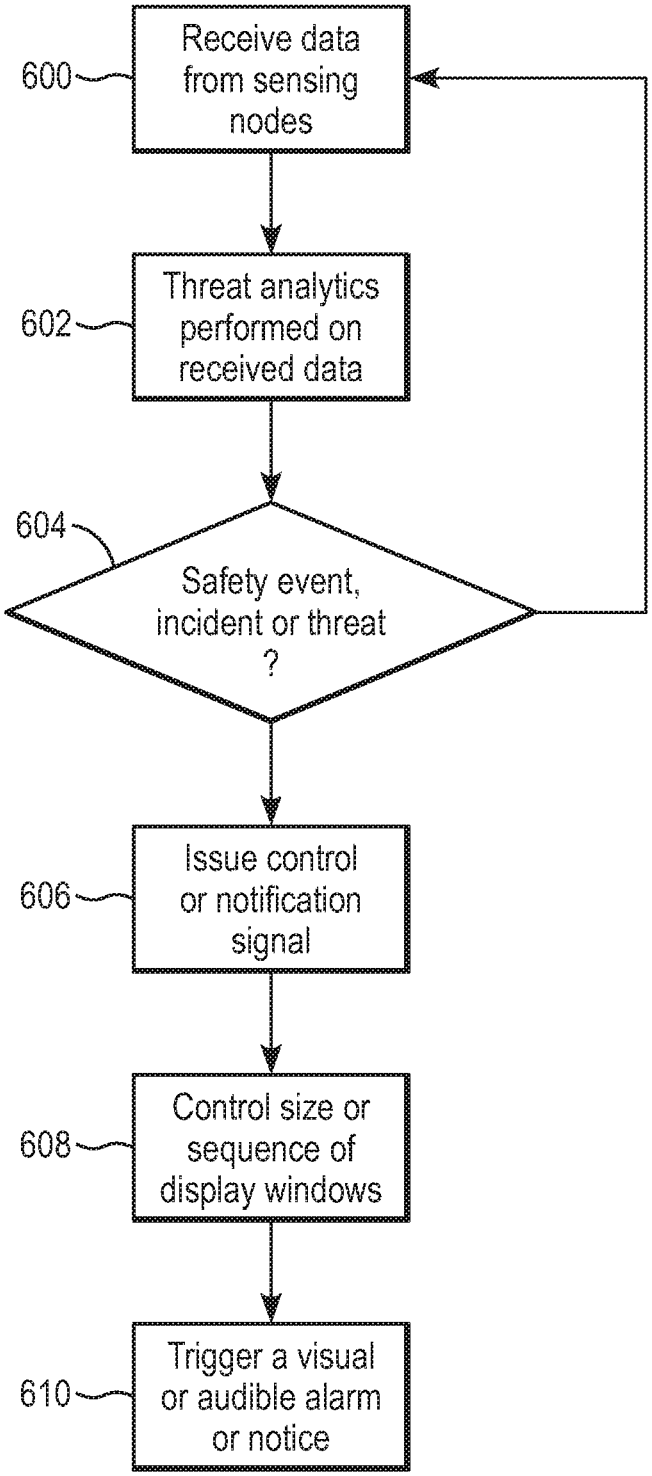
FIG. 6 illustrates a method of detecting a threat in a venue using a network of sensing nodes according to the present disclosure.

FIG. 6 illustrates an exemplary method for detecting a threat in a venue using a network of sensing nodes according to the present disclosure. This method is executed by one or more processors or processing devices at the command center 300. A first step 600 includes receiving data from a plurality of sensing nodes in the network, wherein a plurality of sensing nodes are arranged in zones. In order to perform detection operations, each sensing node is calibrated based on a location in the venue. For example, the calibration can involve at least configuring the sensing nodes based on a desired detection and/or communication range. Moreover, the sensing nodes can be calibrated based on the type of sensor modules that are installed. The baseline data of each sensor is then recorded in memory or database at the command center 300. Threat analytics are performed on the data from each sensing node, which can include at least comparing the data from the sensing nodes to the baseline data (Step 602). The results of the threat analytics for each zone are displayed in respective windows, wherein the windows are ordered or sized relative to a level of threat determined from the threat analytics results, the order or size of the respective windows changing in real-time based on updated threat analytic results. The appearance, order, size, or various other attributes of the windows can be dynamically adjusted according to the type, level, and/or location of the threat. For example, the size of each window can gradually or instantly changed in direct proportion to a change in the threat level. The windows can provide for displaying video or still images within at least a portion of one window in the display. To provide for dynamic adjustment of the window attributes, the system must be calibrated.

Once the system has been calibrated, upon receiving data from the plurality of sensors, the processor(s) at the command center 300 determine whether comparison results indicate a safety event, incident, or threat to safety in the location of a respective sensing node (step 604). A control or notification signal is issued based on a result of the determination (step 606). Based on the control or notification signal, the size or order sequence of windows in the display can be changed based on the control or notification signal (step 608). According to an exemplary embodiment, the processor(s) at the command center calculate execute an algorithm for assigning a score to the threat level based on the comparison of the detected and baseline data. The control or notification signal includes the score associated with a threat level and the size or sequence placement of a respective window is adjusted based on the score in relation to other windows in the display. In addition, the command center processor(s) can be configured to use the control or notification signal to control a plurality of sensing nodes in a common zone to focus on a detected threat, and if at least one sensing node in the common zone includes a camera, the camera is controlled to provide images of an area in which the threat is detected. At least one sensor in the network of sensors can be attached to an animate object for tracking the object's movement within a zone. The command center processor(s) can be configured to send the control or notification signal to the sensor, such that upon a receipt of the control or notification signal, a first processor of the sensing node attached to the animate object communicates with second processors of other sensing nodes in the zone. The command center processor(s) can determine a position of the animate object in the zone based on a proximity of the animate object to at least one other sensing node in the common zone. The command center 300 processor(s) can trigger a visual or audible alarm or notice based on the control or notification signal (step 610).

The command center 300 of FIG. 1 may be implemented in a computer system using hardware, software, firmware, non-transitory computer readable media having instructions stored thereon, or a combination thereof and may be implemented in one or more computer systems or other processing systems. Hardware, software, or any combination thereof may embody modules and components used to implement the methods of FIG. 6.

If programmable logic is used, such logic may execute on a commercially available processing platform or a special purpose device. A person having ordinary skill in the art may appreciate that embodiments of the disclosed subject matter can be practiced with various computer system configurations, including multi-core multiprocessor systems, minicomputers, mainframe computers, computers linked or clustered with distributed functions, as well as pervasive or miniature computers that may be embedded into virtually any device. For instance, at least one processor device and a memory may be used to implement the above described embodiments.

A processor unit or device as discussed herein may be a single processor, a plurality of processors, or combinations thereof. Processor devices may have one or more processor "cores." The terms "computer program medium," "non-transitory computer readable medium," and "computer usable medium" as discussed herein are used to generally refer to tangible media such as a removable storage unit and a hard disk installed in hard disk drive.

Various embodiments of the present disclosure are described in terms of this example computer system. After reading this description, it will become apparent to a person skilled in the relevant art how to implement the present disclosure using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device may be a special purpose or a general purpose processor device. The processor device may be connected to a communications infrastructure, such as a bus, message queue, network, multi-core message-passing scheme, etc. The network may be any network suitable for performing the functions as disclosed herein and may include a local area network (LAN), a wide area network (WAN), a wireless network (e.g., Wi-Fi), a mobile communication network, a satellite network, the Internet, fiber optic, coaxial cable, infrared, radio frequency (RF), or any combination thereof. Other suitable network types and configurations will be apparent to persons having skill in the relevant art. The computer system may also include a main memory (e.g., random access memory, read-only memory, etc.), and may also include a secondary memory. The secondary memory may include the hard disk drive and a removable storage drive, such as a floppy disk drive, a magnetic tape drive, an optical disk drive, a flash memory, etc.

The removable storage drive may read from and/or write to the removable storage unit in a well-known manner. The removable storage unit may include a removable storage media that may be read by and written to by the removable storage drive. For example, if the removable storage drive is a floppy disk drive or universal serial bus port, the removable storage unit may be a floppy disk or portable flash drive, respectively. In one embodiment, the removable storage unit may be non-transitory computer readable recording media.

In some embodiments, the secondary memory may include alternative means for allowing computer programs or other instructions to be loaded into the computer system, for example, the removable storage unit and an interface. Examples of such means may include a program cartridge and cartridge interface (e.g., as found in video game systems), a removable memory chip (e.g., EEPROM, PROM, etc.) and associated socket, and other removable storage units and interfaces as will be apparent to persons having skill in the relevant art.

Data stored in the computer system (e.g., in the main memory and/or the secondary memory) may be stored on any type of suitable computer readable media, such as optical storage (e.g., a compact disc, digital versatile disc, Blu-ray disc, etc.) or magnetic tape storage (e.g., a hard disk drive). The data may be configured in any type of suitable database configuration, such as a relational database, a structured query language (SQL) database, a distributed database, an object database, etc. Suitable configurations and storage types will be apparent to persons having skill in the relevant art.

The computer system may also include a communications interface. The communications interface may be configured to allow software and data to be transferred between the computer system and external devices such as the sensing nodes. Exemplary communications interfaces may include a modem, a network interface (e.g., an Ethernet card), a communications port, a PCMCIA slot and card, etc. Software and data transferred via the communications interface may be in the form of signals, which may be electronic, electromagnetic, optical, or other signals as will be apparent to persons having skill in the relevant art. The signals may travel via a communications path, which may be configured to carry the signals and may be implemented using wire, cable, fiber optics, a phone line, a cellular phone link, a radio frequency link, etc.

The computer system may further include a display interface. The display interface may be configured to allow data to be transferred between the computer system and external display. Exemplary display interfaces may include high-definition multimedia interface (HDMI), digital visual interface (DVI), video graphics array (VGA), etc. The display may be any suitable type of display for displaying data transmitted via the display interface of the computer system, including a cathode ray tube (CRT) display, liquid crystal display (LCD), light-emitting diode (LED) display, capacitive touch display, thin-film transistor (TFT) display, etc.

Computer program medium and computer usable medium may refer to memories, such as the main memory and secondary memory, which may be memory semiconductors (e.g., DRAMs, etc.). These computer program products may be means for providing software to the computer system. Computer programs (e.g., computer control logic) may be stored in the main memory and/or the secondary memory. Computer programs may also be received via the communications interface. Such computer programs, when executed, may enable computer system to implement the present methods as discussed herein. In particular, the computer programs, when executed, may enable one or more processor devices to implement and/or execute the method of detecting a threat in a venue as illustrated in FIG. 6, as discussed herein. Accordingly, such computer programs may represent controllers of the computer system. Where the present disclosure is implemented using software, the software may be stored in a computer program product and loaded into the computer system using the removable storage drive, interface, and hard disk drive, or communications interface.

The processor device may comprise one or more modules or engines configured to perform the functions of the computer system. Each of the modules or engines may be implemented using hardware and, in some instances, may also utilize software, such as corresponding to program code and/or programs stored in the main memory or secondary memory. In such instances, program code may be compiled by the processor device (e.g., by a compiling module or engine) prior to execution by the hardware of the computer system. For example, the program code may be source code written in a programming language that is translated into a lower level language, such as assembly language or machine code, for execution by the processor device and/or any additional hardware components of the computer system. The process of compiling may include the use of lexical analysis, preprocessing, parsing, semantic analysis, syntax-directed translation, code generation, code optimization, and any other techniques that may be suitable for translation of program code into a lower level language suitable for controlling the computer system to perform the functions disclosed herein. It will be apparent to persons having skill in the relevant art that such processes result in the computer system being a specially configured computer system uniquely programmed to perform the functions discussed above.

The exemplary embodiments described in the present disclosure provide several advantages over known monitoring systems in that the threat detection system does much more than merely monitor for threats, detect threats, and notify of threats. The exemplary threat detection system and methods described herein provide a predictive, descriptive, and prescriptive analytical solution that can use baseline or previously recorded data to learn about its environment and the occurrence of previous threats or incidents. The processor(s) can be configured with algorithms to perform machine learning, which allow the threat detection system and method described herein to learn from the data obtained from the plural sensing modules deployed around the venue. This allows predictive and prescriptive analysis of the detected data so that the system can provide advanced notification and intelligence to first responders. For example, based on data collected in the area surrounding a venue, the threat detection system can be configured to determine and/or estimate the approximate number of responding units needed to properly address or resolve the incident. Notification can be sent to any and all necessary first responders. According to an exemplary embodiment, the notification signal includes data from the sensors that is packaged and/or presented to provide the necessary detail for first responders to assess the circumstances surrounding the incident and threat to which they are responding. For example, the data can include the approximate size of isolated area of incident, the type of incident (e.g., fire, shooting, vehicle accident, structural incident, environmental impact of incident, etc.), suspected cause of incident, approximate number of casualties, video and/or picture of area, video and/or picture of suspect, or any other desired information that can be culled, obtained, and/or derived from the raw sensor data.

It should be appreciated that any of the components or modules referred to with regards to any of the present invention embodiments discussed herein, may be integrally or separately formed with one another. Further, redundant functions or structures of the components or modules may be implemented.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A threat detection system, comprising:

a plurality of nodes, each node configured for monitoring a specified area, wherein at least one node includes a modular device for secure attachment to an object within the specified area, the modular device having at least one compartment for interchangeably receiving a sensor of a specified type, a processor, and a transceiver for data communication over a network;

a controller configured to determine a safety threat level based on data received from at least two nodes positioned in different zones in the specified area; and a display device configured to display a plurality of windows as a sequence of tiles, wherein each window is associated with a respective zone, and the display is further configured to display each window in a display sequence and at a display size based on the safety threat level of each zone determined from the data received from the at least two nodes.

2. The system of claim 1, wherein at least one sensor is disposed in a housing configured to be detachably connected to the modular device.

3. The system of claim 2, wherein the housing includes a first connector that mates with a second connector on the modular device.

4. The system of claim 1, wherein the modular device includes a processor configured to detect a type of the at least one sensor disposed in the housing connected thereto.

5. The system of claim 1, wherein the modular device includes a processor configured to detect connection to a housing and identify a type of sensor provided in the housing.

6. The system of claim 1, wherein the processor is configured to perform a diagnostic test on the at least one sensor provided in the housing.

7. The system of claim 1, wherein each node is configured to communicate at least one of sensor and diagnostic data to the controller.

8. The system of claim 1, wherein the controller includes a processor configured to perform threat analytics on the received sensor data.

9. The system of claim 1, wherein the controller includes a display that aggregates received sensor data into visual format for a user.

10. The system of claim 9, wherein the display is configured to display a result of threat analytics processing on the received sensor data.

11. The system of claim 10, wherein the display is configured to identify the location of a threat or incident based on the result of the threat analytics processing.

12. The system of claim 1, wherein the display size each of the plurality of windows includes dimensions based on the result of the threat analytics processing, wherein a window associated with sensor data indicating an imminent or current threat has a larger size than a window associated with sensor data indicating no threat.

13. A method for detecting a threat in a venue using a network of sensing nodes, comprising:

receiving data from a plurality of sensing nodes in the network, wherein a plurality of sensing nodes are arranged in zones;

performing threat analytics on the data from each sensing node; and displaying results of the threat analytics for each zone in respective windows, wherein the windows are ordered and sized relative to a level of threat determined from the threat analytics results, the order or size of the respective windows changing in real-time based on updated threat analytic results.

14. The method of claim 13, wherein performing threat analytics comprises:

calibrating each sensing node based on a location in the venue;

recording baseline data of each sensor;

comparing the received sensor data to the baseline data associated with the respective sensor;

determining whether comparison results indicate a safety event in the location of a respective sensing node; and issuing a control or notification signal based on a result of the determination.

15. The method of claim 14, comprising:

changing a size or order sequence of windows in the display based on the control or notification signal, wherein the control or notification signal includes a score associated with a threat level and the size or sequence placement of a respective window is adjusted based on the score in relation to other windows in the display.

16. The method of claim 15, wherein one of the plurality of sensing nodes is attached to an animate object, the method further comprising:

tracking movement of the animate object within a zone, wherein based on a received control or notification signal, a first processor of the sensing node attached to the animate object communicates with second processors of other sensing nodes in the zone, and determining a position of the animate object in the zone based on a proximity of the animate object to at least one other sensing node in the common zone.

17. A non-transitory computer readable medium encoded with a method for detecting a threat in a venue, wherein when the computer readable medium is placed in communicable contact with a processing device, the processing device is configured to execute the method comprising:

receiving data from a plurality of sensing nodes in the network, wherein in a plurality of sensing nodes are arranged in zones;

performing threat analytics on the data from each sensing node; and displaying results of the threat analytics for each zone in respective windows, wherein the windows are ordered and sized relative to a level of threat determined from the threat analytics results, the order or size of the respective windows changing in real-time based on updated threat analytic results.

* * * * *